US009593561B2

(12) United States Patent
Xiao et al.

(10) Patent No.: US 9,593,561 B2
(45) Date of Patent: Mar. 14, 2017

(54) HANGER AND PENETRATOR FOR THROUGH TUBING ESP DEPLOYMENT WITH A VERTICAL PRODUCTION TREE

(71) Applicant: Saudi Arabian Oil Company, Dhahran (SA)

(72) Inventors: Jinjiang Xiao, Dhahran (SA); Brian Roth, Dhahran (SA); Brett Bouldin, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 291 days.

(21) Appl. No.: 14/020,222

(22) Filed: Sep. 6, 2013

(65) Prior Publication Data

US 2015/0068769 A1 Mar. 12, 2015

(51) Int. Cl.
*E21B 43/12* (2006.01)
*E21B 33/04* (2006.01)

(52) U.S. Cl.
CPC ..... *E21B 43/12* (2013.01); *E21B 33/0407* (2013.01)

(58) Field of Classification Search
CPC ..... E21B 43/12; E21B 34/10
USPC ..... 166/382, 72, 67
See application file for complete search history.

(56) References Cited

U.S. PATENT DOCUMENTS 3,638,732 A 2/1972 Huntsinger et al.
4,154,302 A 5/1979 Cugini
4,181,175 A * 1/1980 McGee ..... E21B 33/047 166/88.4
4,289,199 A 9/1981 McGee
4,491,176 A 1/1985 Reed
4,627,489 A 12/1986 Reed
4,804,045 A 2/1989 Reed
5,848,646 A * 12/1998 Huber ..... E21B 17/046 166/297
6,200,152 B1 3/2001 Hopper
6,974,341 B2 12/2005 Jennings
7,165,620 B2 1/2007 Steedman
7,445,046 B2 * 11/2008 Borak, Jr. ..... E21B 33/04 166/313

(Continued)

FOREIGN PATENT DOCUMENTS

CN 2437845 7/2001
CN 25289214 1/2003

(Continued)

OTHER PUBLICATIONS

Neuroth, David H. and Bayh, Russell D., III, Demonstration of a New Cable-Deployed Pumping System to the Oil Industry, 1988 SPE Artificial Lift Workshop, Apr. 28-29, 1988, Houston, Texas.

(Continued)

*Primary Examiner* — Taras P Bemko
(74) *Attorney, Agent, or Firm* — Bracewell LLP; Constance G. Rhebergen; Vivek P. Shankam

(57) ABSTRACT

A hanger assembly for use in a vertical production tree that includes an annular piping spool member having a side opening, and a hanger having an outer surface profiled to selectively land in the piping spool member and a side opening registered with the side opening of the piping spool member. The hanger assembly also includes a vertical penetrator having an end selectively connected to a submersible device and an opposing end inserted into the hanger, and that is in communication with the side openings.

21 Claims, 2 Drawing Sheets

(56) References Cited

U.S. PATENT DOCUMENTS

| | | | |
|---|---|---|---|
| 7,770,650 | B2 | 8/2010 | Young et al. |
| 8,157,015 | B2 | 4/2012 | Voss et al. |
| 2004/0231835 | A1 | 11/2004 | Thai et al. |
| 2010/0206577 | A1 | 8/2010 | Martinez |
| 2011/0300008 | A1 | 12/2011 | Fielder et al. |

FOREIGN PATENT DOCUMENTS

| | | | |
|---|---|---|---|
| GB | 2 504 104 | A | 1/2014 |
| WO | 2012045771 | A2 | 4/2012 |

OTHER PUBLICATIONS

PCT International Search Report and the Written Opinion; dated Apr. 20, 2015; International Application No. PCT/U52014/052435; International File Date: Aug. 25, 2014.

* cited by examiner

HANGER AND PENETRATOR FOR THROUGH TUBING ESP DEPLOYMENT WITH A VERTICAL PRODUCTION TREE

BACKGROUND OF THE INVENTION

1. Field of the Invention

The present technology relates to oil and gas production. In particular, the present technology relates to the deployment of electric submersible pumps in vertical production trees.

2. Description of the Related Art

Production trees are typically used during the production of oil and gas on both surface and subsea wells. Production trees principally isolate, direct, and control the flow of oil, gas, and other fluids out of a well, and generally include valves that control such flow. In addition, production trees can be used to perform other functions, such as injecting chemicals into a well, relieving pressure from a well, and monitoring conditions within the well. Typically, production trees are classified as either horizontal or vertical production trees. Horizontal production trees are those where the oil and gas is brought to the wellhead, and then diverted horizontally through the master valves, swab valve, and other components. Vertical production trees are those where the production path, including components of the tree such as the master valves and swab valve, are stacked vertically above the wellhead.

In many wells, the pressure within the well is sufficient that producing oil and gas from the well requires only the installation of a production tree, and the opening of valves on the tree to allow the oil and gas to flow out of the well. In some instances, however, the pressure in the well is not sufficient to produce the oil and gas at acceptable rates. In such circumstances, it can be necessary to add an artificial lift mechanism, such as an electric submersible pump (ESP), to help lift the oil and gas from the well. Furthermore, in some circumstances, a well that initially has sufficient pressure to produce without artificial lift may experience a decrease in well pressure, thereby arriving at a point where artificial lift is required.

SUMMARY OF THE INVENTION

One embodiment of the present technology provides a hanger assembly for use in a vertical production tree. The hanger assembly includes an annular piping spool member having a side opening, and a hanger having an outer surface profiled to selectively land in the piping spool member and a side opening registered with the side opening of the piping spool member. The hanger assembly also includes a vertical penetrator having an end selectively connectable to a submersible device and an opposing end inserted into the hanger, and that is in communication with the side openings. The hanger assembly can also include a submersible device attached to and suspended from the hanger, the submersible device electrically connected to surface equipment through the side openings of the hanger and the piping spool member.

In addition, the piping spool member can have a shoulder and can be located in the vertical production tree below the master production valve of the vertical production tree, and the hanger can have a lip arranged to contact the shoulder of the piping spool member to limit downward movement of the hanger relative to the piping spool member.

The piping spool member can have a pin and the hanger can have a slot, the pin and the slot positioned so that the slot must accept the pin for the hanger to be fully seated against the piping spool member with the lip of the hanger contacting the shoulder of the piping spool member, and so that when the pin and slot are aligned, the opening on the side of the hanger is aligned with the side opening of the piping spool member. In addition, the hanger assembly can include a plug for insertion into the side opening of the piping spool member to seal the opening during makeup and breakdown of the assembly.

In some embodiments, the piping spool member can have multiple fluid bypass ports, the aggregate cross-sections of which are large enough to limit fluid velocity below a predetermined velocity. In addition, the hanger can include a latching shape at an upper end configured for releasable attachment to a running tool. The vertical penetrator of the hanger assembly can also contain cables for connection to a submersible device, wherein the inside of the vertical penetrator and the opening in the hanger and the piping spool member are isolated from pressure in a well bore.

Another embodiment of the present technology provides a vertical production tree, which includes a piping spool, and a hanger assembly positioned in the piping spool. The hanger assembly includes a piping spool member having shoulder, a side opening, and a fluid bypass port, the piping spool member attached to the tubing bonnet, and a hanger adapted for insertion in the piping spool member, and having a lip arranged to contact the shoulder of the piping spool member to limit downward movement of the hanger relative to the piping spool member, the hanger having a vertical penetrator that is open to a side of the hanger and that can be accessed via the side opening of the piping spool member. The hanger assembly also has a submersible device attached to and suspended from the hanger, the submersible device electrically connected to surface equipment through the hanger and the side opening of the piping spool member. The inner diameter of the piping spool member is large enough to allow passage of the submersible device.

As claimed herein below, the fluid bypass port of the piping spool member is separate from the side opening, so that an operator can control the submersible device by communicating with the submersible device and providing power through the side opening while oil and gas is simultaneously being produced through the fluid bypass port. In addition, the hanger assembly can further include a plug for insertion into the side opening of the piping spool member to seal the opening during insertion and removal of the hanger assembly. The hanger can also include a latching shape at an upper end configured for releasable attachment to a running tool.

Yet another embodiment of the present technology provides a method of through tubing ESP deployment on a vertical production tree attached to the opening of a well. The method includes the steps of attaching a piping spool with a shoulder and a fluid bypass port to a wellhead tubing hanger below the master valve of a vertical production tree so that an opening on the sidewall of the piping spool aligns with an opening in a sidewall of the wellhead tubing hanger, and sealing the opening in the wellhead tubing hanger with a plug. The method also includes deploying an electric submersible pump (ESP) through the piping spool and wellhead tubing hanger, and down the wellbore to a predetermined location in the production tubing, the ESP suspended by a cable, and attaching a cable hanger having a circumferential lip and a side port to the cable. In addition, the method includes running the cable hanger into the piping spool and setting the cable hanger so that the circumferential lip contacts the shoulder of the piping spool and the side port of the cable hanger is aligned with the openings of the piping spool and the wellhead tubing hanger, and removing the plug from the opening in the wellhead tubing hanger and electrically communicating with the ESP through the openings in the wellhead tubing hanger and piping spool, and the side port of the cable hanger.

In some embodiments, the method can further include one or more of the steps of installing a lubricator and blow-out preventer (BOP) above the lower master valve before the step of deploying the ESP, installing the ESP in the lubricator, opening the BOP and lubricator, and pressurizing the ESP to the well pressure before deploying the ESP into the well. Further steps can also include closing the BOP on the cable attached to the ESP before the ESP reaches its setting depth, bleeding the pressure from the lubricator, and removing the lubricator, thereby exposing the cable prior to the step of attaching the cable hanger to the cable.

Some embodiments of the method can also include reinstalling the lubricator after attaching the cable hanger to the cable, opening the BOP to release the cable, thereby allowing the ESP to travel further down the well, attaching a running tool to the cable hanger and using the running tool to run the cable hanger into position relative to the piping spool, closing the lower master valve, and removing the BOP and lubricator prior to the step of removing the plug from the opening in the wellhead tubing hanger.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE EXEMPLARY EMBODIMENTS

Figure 1:
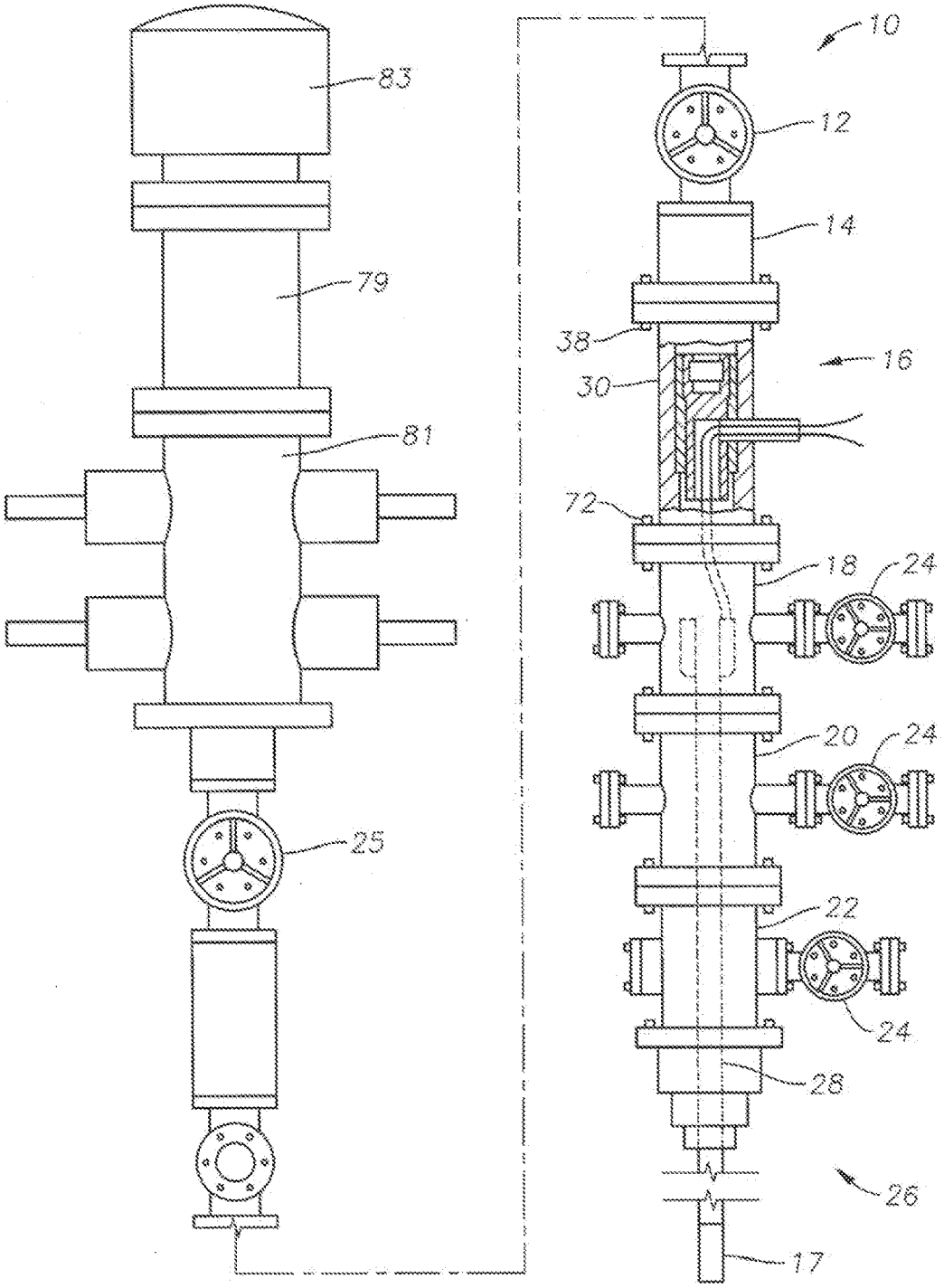
FIG. 1 is a side partial cross-sectional view of a vertical production tree according to an embodiment of the present technology.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, the embodiments are not intended to be limited to the specific terms used, and it is to be understood that each specific term includes equivalents that operate in a similar manner to accomplish a similar purpose.

FIG. 1 is a side partial cross-sectional view of a vertical production tree 10 according to an embodiment of the present technology. The vertical production tree 10 includes a lower master valve 12 which is positioned above a tubing bonnet 14. The tubing bonnet 14 is attached to a hanger assembly 16, the structure of which is shown in greater detail in FIG. 2, and which is capable of allowing passage of an electric submersible pump (ESP) 17 or other device in to the well without removal of the vertical production tree 10. Although one embodiment of the technology can be used to aid in insertion of an ESP into a well, it is to be understood that other tools and devices can be introduced to the well through the technology herein described. Examples of other such tools and devices include heater cables for gas well deliquidification, alternative types of artificial lift systems, such as progressive cavity pumps, and systems for monitoring well parameters, such as temperature, pressure, and corrosion. For ease of discussion, an ESP is discussed hereinbelow in describing the technology, but the invention is not limited to use with an ESP.

Below the hanger assembly 16 are additional components that are part of the vertical production tree 10, such as, for example, a tubing spool 18, a casing spool 20, and a casing heel 22. Various control valves 24 are positioned on the vertical production tree 10 to regulate the flow of liquids into and out of the tree as required by production operations. A swab valve 25 on an upper end of the vertical production tree 10 provides selective access to its main bore. The vertical production tree 10 sits at the top of a well 26, and encloses production tubing 28 that extends into the well 26 and provides a conduit for oil and gas to exit the well 26 through the vertical production tree 10.

Figure 2:
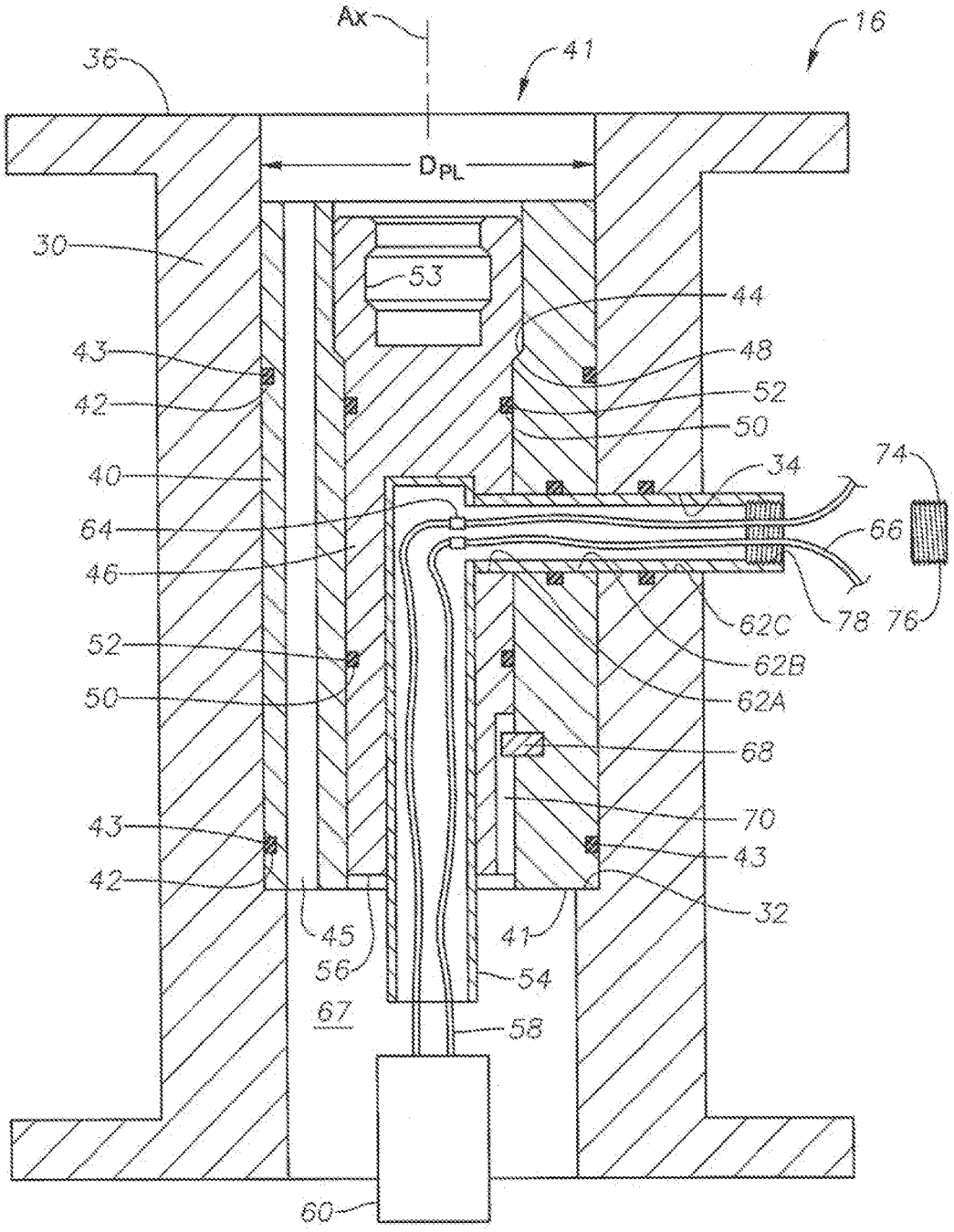
FIG. 2 is an enlarged cross-sectional view of a hanger assembly for use with the vertical production tree according to an embodiment of the present technology.

Referring to FIG. 2, there is shown an enlarged cross-sectional view of the hanger assembly 16 according to the present technology. The hanger assembly 16 has an annular piping spool 30 with a piping spool shoulder 32 and a piping spool opening 34. Piping spool shoulder 32 is defined where an inner diameter $D_{PL}$ of spool 30 reduces to form a ledge. Piping spool opening 34 projects radially through a side wall of the piping spool 30 above the piping spool shoulder 32. The upper end 36 of the piping spool 30 is adapted to attach to the tubing bonnet 14 such as, for example, using bolts 38 or other fasteners (as shown in FIG. 1).

An annular fluid bypass port member 40 is adapted for positioning coaxially within a main bore 41 in the piping spool 30. The outer diameter of the fluid bypass port member 40 is slightly smaller than the inner diameter $D_{PL}$ of the piping spool 30 above the piping spool shoulder 32, so that when the fluid bypass port member 40 is positioned within the piping spool 30, a bottom end 41 of the fluid bypass port member 40 rests against and is supported by the piping spool shoulder 32. Thus, downward movement of the fluid bypass port member 40 relative to the piping spool 30 is restricted by the piping spool shoulder 32. The fluid bypass port member 40 can also include recesses 42 circumscribing its outer surface for receiving seals 43. The seals 43 can be elastomeric, and seal the interface between the piping spool 30 and the fluid bypass port member 40. The inner diameter of the fluid bypass port member 40 is large enough to allow the passage of the ESP 17. Furthermore, the fluid bypass port member 40 further includes a fluid bypass port member shoulder 44 on the inner surface thereof. In some embodiments, the piping spool 30 and fluid bypass port member 40 can be one integral piece.

The fluid bypass port member 40 includes at least one production port 45, shown formed axially through fluid bypass port member 40 and offset from Axis $A_x$ of main bore 41, which provides a path for oil, gas, and other fluids to pass from below the hanger assembly 16 to above the hanger assembly 16. In alternate embodiments, there can be multiple production ports. The cross-sectional area of the production port 45, or the aggregate cross-sectional area of the multiple production ports, as the case may be, is large enough to keep the flow velocity of the fluids through the ports below a threshold specified by industrial standards.

FIG. 2 also shows a cable hanger 46 that is adapted for insertion in the fluid bypass port member 40. The cable hanger 46 has an outer diameter that transitions inward to define a downward facing cable hanger lip 48, shown landed on the upward facing fluid bypass port member shoulder 44. The interaction between the fluid bypass port member shoulder 44 and the lip 48 of the cable hanger 46 supports cable hanger 46 in the vertical production tree 10, and limits its downward movement relative to the fluid bypass port member 40. In some embodiments, the cable hanger 46 can have recesses 50 circumscribing its outer surface for accepting seals 52. The seals 52 can be elastomeric, and can seal the interface between the inner surface of the fluid bypass port member 40 and the outer surface of the cable hanger 46.

The cable hanger 46 of FIG. 2 also includes a latch 53 at an upper end thereof that is shaped to releasably connect with a running tool (not shown). During makeup of the hanger assembly 16, and in particular insertion of the cable hanger 46 into the fluid bypass port member 40, the running tool can be attached to the latch 53 to direct the movement of the cable hanger 46 into the assembly 16. When the cable hanger 46 is landed, the running tool can then release the latch 53 and be removed. In addition, the cable hanger 46 also includes a vertical penetrator 54 that extends axially into the cable hanger 46 from the bottom 56 thereof, and that houses cables 58. The vertical penetrator 54 can be separate from the from the cable hanger 46, and can be machined or molded to prevent the ingress of production fluids. In addition, the vertical penetrator 54 can be held in place relative to the cable hanger 46 by a should or thread (not shown). In addition, the cable 58 can be attached to the vertical penetrator 54 by any appropriate means, such as, for example, with a slip and nut connector similar to a coiled tubing connector, or by cable heading if braided cable is used. The cable 58 extends downhole through a cable connector 60 to the ESP 17 to provide power, controls, etc. to the ESP 17 or other device.

The piping spool 30, fluid bypass port member 40, and cable hanger 46 have side openings 62A, 621B, and 62C respectively. Openings 62A, 62B, and 62C are shown registered with one another and extending radially outward from axis $A_x$. These side openings 62A, 62B, 62C provide access from outside the piping spool 30 to a cable connection 64 at the top of the cables 58 within the vertical penetrator 54. The cable connection 64 can be, for example, a 3-phase AC power supply. When the openings 62A, 62B, and 62C are properly aligned, cables 66 can be passed through the openings 62A, 62B, and 62C and connected to the cable connection 64. Through the cables 58, 66, the ESP 17 can be electrically connected to equipment outside the vertical production tree 10. This electrical connection can provide power to the ESP 17, as well as other data, such as control data, etc. The openings 62A, 62B, and 62C are separated from the flow area 67 so that the cable connection 64 can be accessed and the ESP 17 can be controlled while oil and gas is being simultaneously produced through production port(s) 45.

To ensure that the opening 62A of the cable hanger 46 aligns with the openings 62B, 62C of the fluid bypass port member 40 and piping spool 30 upon insertion of the cable hanger 46, self-orienting mechanisms are provided in the assembly 16. For example, in the embodiment shown in FIG. 2, a self-orienting pin 68 can be included in the inner sidewall of the fluid bypass port member 40, and can protrude inwardly from the inner surface of the fluid bypass port member 40. In addition, a self-orienting pin receiving slot 70 can be cut in a portion of the outer surface of the cable hanger 46. The self-orienting pin 68 and the self-orienting pin receiving slot 70 are arranged so that when aligned, the opening 62A of the cable hanger 46 aligns with the openings of 62B, 62C of the fluid bypass port member 40 and the piping spool 30 respectively. When the cable hanger 46 is inserted into the fluid bypass port member 40, unless the self-orienting pin 68 and the self-orienting pin receiving slot 70 are aligned, the cable hanger 46 cannot fully insert into the fluid bypass port member 40. Instead, the bottom of the cable hanger 46 will contact self-orienting pin 68 rather than the self-orienting pin 68 being inserted into self-orienting pin receiving slot 70. Thus, when the cable hanger 46 is fully seated, an operator will know that the openings 62A, 62B, 62C are aligned.

The hanger assembly 16 shown in FIG. 2 and described herein above is effective to allow insertion of the ESP 17 through the fluid bypass port member 40, and subsequent control of the ESP 17 by cable through openings 62A, 62B, 62C in the side of the of components of the hanger assembly 16. In addition, the assembly still allows production of oil and gas through the vertical production tree because the fluids can pass the hanger assembly 16 via the production port(s) 45 in the fluid bypass port member 40. Insertion of the ESP 17 and makeup of the hanger assembly 16 is described in detail below.

Installation of the piping spool 30 and fluid bypass port member 40 can be accomplished while the well is dead. Initially, the well is killed, and all components from the lower master valve 12 upward are removed from the production tree 10 (shown in FIG. 1). Next, the piping spool 30 and fluid bypass port member 40, which can be preassembled together, are attached to the wellhead tubing spool 18 using, for example, fasteners 72 (shown in FIG. 1), which may be bolts. The openings 62A, 62B, and 62C are closed with a plug 74 or cap that can be inserted into the opening 62C in the piping spool 30. The plug 74 can be held in place by any appropriate means. For example, the plug 74 may have external threads 76 that correspond to internal threads 78 in opening 62C. The purpose of the plug 74 can be to cover and electrically protect the cable connection 64. After the piping spool 30 and fluid bypass port member 40 are attached to the wellhead tubing spool 18, the lower master valve 12 and other wellhead components are reinstalled on top of the piping spool 30. As shown in FIG. 1, tubing bonnet 14 can be positioned between the lower master valve 12 and the hanger assembly 16. The piping spool 30 can be attached to the tubing bonnet 14, lower master valve 12, or other components by any appropriate means, such as, for example, with fasteners 38.

With the piping spool 30 and fluid bypass port member 40 thus attached to the vertical production tree 10, the ESP 17 can be lowered into and set in the well 26 while the well is live. To accomplish this, a pressure containing lubricator 79 and a blowout preventer (BOP) 81 are installed above the lower master valve 12. The cable 58 is attached to the ESP 17 at a top end and the ESP 17 is inserted into the lubricator by passing through a stuffing box 83 through pressure containing seals at the top of the lubricator. At this point, the BOP is opened, and the lubricator and ESP 17 are pressurized up to the well pressure.

Once it has been pressurized, the ESP 17 is deployed downwardly through the vertical production tree 10, including through the piping spool 30 and fluid bypass port member 40, to a predetermined location in the well. As the ESP 17 is lowered, the cable 58 is fed into the well so that the lower end of the cable 58 remains attached to the ESP 17 and the upper end remains above the BOP and outside of the well. Just before the ESP 17 reaches its intended setting depth, the BOP is closed on the cable 58 to hold the cable 58 and the ESP 17 in place and to contain the well pressure.

Then the lubricator pressure is bled off, and the lubricator is removed, thereby exposing the top of the cable 58.

With the lubricator removed, the cable hanger 46 is attached to the top of the cable 58, with the cable 58 extending into the vertical penetrator 54 as shown in FIG. 2. The cable hanger 46 is then attached, via the latch 53, to a running tool to complete installation of the cable hanger 46 and the ESP 17. The lubricator is reinstalled, the BOP is reopened, and the running tool pushes the cable hanger 46 downward until it is seated on the fluid bypass port member 40 as described above. The self-orienting pin 68 and self-orienting pin receiving slot 70, of the fluid bypass port member 40 and the cable hanger 46 respectively, align to ensure that when the cable hanger 46 is fully seated the opening 62A aligns with openings 62B, 62C of the fluid bypass port member 40 and the piping spool 30. Once the cable hanger 46 is set, the running tool is released from the latch 53 and retrieved into the lubricator. The lower master valve 12 is then closed and the lubricator and BOP are removed. On the piping spool 30, the previously installed plug 74 can be removed from the opening 62C, and cable 66 can be connected to cable connection 64 to establish electrical communication between the ESP 17 and surface equipment outside the vertical production tree 10. To withdraw the ESP 17 from the well, the above described process is reversed.

One advantage to the technology described herein is that is reduces the need to replace vertical wellheads with horizontal wellheads in order to introduce an ESP or other device into a well through the wellhead. Instead, the technology of the present application allows for retrofitting existing vertical wellheads. This can be beneficial particularly in established oil fields, where vertical wellheads may already be in use, and replacement with horizontal wellheads would be costly and inefficient.

Although the technology herein has been described with reference to particular embodiments, it is to be understood that these embodiments are merely illustrative of the principles and applications of the present technology. It is therefore to be understood that numerous modifications can be made to the illustrative embodiments and that other arrangements can be devised without departing from the spirit and scope of the present technology as defined by the appended claims.

What is claimed is:

1. A hanger assembly for use in a piping spool of a vertical production tree, the hanger assembly comprising:

an annular piping spool member having a side opening;

a hanger having an outer surface profiled to selectively land in the piping spool member and a side opening registered with the side opening of the piping spool member; and a vertical penetrator having an end inserted into the hanger, and that is in communication with the side openings, the vertical penetrator circumscribing a cable attached to the submersible device.

2. The hanger assembly of claim 1, the submersible device is electrically connected to surface equipment through the side openings of the hanger and the piping spool member.

3. The hanger assembly of claim 1, wherein the vertical production tree has a master production valve, and the piping spool member has a shoulder and is located in the vertical production tree below the master production valve, and wherein the hanger has a lip arranged to contact the shoulder of the piping spool member to limit downward movement of the hanger relative to the piping spool member.

4. The hanger assembly of claim 3, wherein the piping spool member has a pin and the hanger has a slot, the pin and the slot positioned so that the slot must accept the pin for the hanger to be fully seated against the piping spool member with the lip of the hanger contacting the shoulder of the piping spool member, and so that when the pin and slot are aligned, the opening on the side of the hanger is aligned with the side opening of the piping spool member.

5. The hanger assembly of claim 1, further comprising a plug for insertion into the side opening of the piping spool member to seal the opening during makeup and breakdown of the assembly.

6. The hanger assembly of claim 1, wherein the piping spool member has multiple fluid bypass ports, the aggregate cross-sections of which are large enough to limit fluid velocity below a predetermined velocity.

7. The hanger assembly of claim 1, wherein the hanger includes a latching shape at an upper end configured for releasable attachment to a running tool.

8. The hanger assembly of claim 1, wherein the vertical penetrator contains cables for connection to the submersible device, and wherein the openings in the hanger and the piping spool member are isolated from pressure in a well bore.

9. A vertical production tree having a tubing bonnet, comprising:

a piping spool; and a hanger assembly positioned in the piping spool, the hanger assembly comprising:

a piping spool member having a shoulder, a side opening, and a fluid bypass port, the piping spool member attached to the tubing bonnet;

a hanger adapted for insertion in the piping spool member, and having a lip arranged to contact the shoulder of the piping spool member to limit downward movement of the hanger relative to the piping spool member, the hanger having a vertical penetrator that is open to a side of the hanger and that can be accessed via the side opening of the piping spool member; and a submersible device suspended from the hanger by a cable, the submersible device electrically connected to surface equipment through the hanger and the side opening of the piping spool member.

10. The vertical production tree of claim 9, wherein the inner diameter of the piping spool member is large enough to allow passage of the submersible device.

11. The vertical production tree of claim 9, wherein the fluid bypass port of the piping spool member is separate from the side opening, so that an operator can control the submersible device by communicating with the submersible device and providing power through the side opening while oil and gas is simultaneously being produced through the fluid bypass port.

12. The vertical production tree of claim 9, further comprising a plug for insertion into the side opening of the piping spool member to seal the opening during insertion and removal of the hanger assembly.

13. The vertical production tree of claim 9, wherein the hanger includes a latching shape at an upper end configured for releasable attachment to a running tool.

14. A method of through tubing electric submersible pump deployment on a vertical production tree attached to the opening of a well, the method comprising the steps of:

attaching a piping spool with a shoulder and a fluid bypass port to a wellhead tubing hanger below the master valve of a vertical production tree so that an opening on the sidewall of the piping spool aligns with an opening in a sidewall of the wellhead tubing hanger;

sealing the opening in the wellhead tubing hanger with a plug;

deploying an electric submersible pump through the piping spool and wellhead tubing hanger, and down the wellbore to a predetermined location in the production tubing, the electric submersible pump suspended by a cable;

attaching a cable hanger having a circumferential lip and a side port to the cable, the cable hanger having a vertical penetrator that is open to a side of the cable hanger and that can be accessed via the opening on the sidewall of the piping spool;

running the cable hanger into the piping spool and landing the cable hanger so that the circumferential lip contacts the shoulder of the piping spool and the side port of the cable hanger is aligned with the openings of the piping spool and the wellhead tubing hanger;

removing the plug from the opening in the wellhead tubing hanger and electrically communicating with the electric submersible pump through the openings in the wellhead tubing hanger and piping spool, and the side port of the cable hanger.

15. The method of claim 14, further comprising the step of:

installing a lubricator and blow-out preventer above the lower master valve before the step of deploying the electric submersible pump.

16. The method of claim 15, further comprising the steps of:

installing the electric submersible pump in the lubricator; and opening the blow-out preventer and pressurizing the to the well pressure before deploying the into the well.

17. The method of claim 16, further comprising the step of closing the blow-out preventer on the cable attached to the electric submersible pump before the electric submersible pump reaches its setting depth.

18. The method of claim 17, further comprising the steps of:

bleeding the pressure from the lubricator; and removing the lubricator, thereby exposing the cable prior to the step of attaching the cable hanger to the cable.

19. The method of claim 18, further comprising the steps of:

reinstalling the lubricator after attaching the cable hanger to the cable; and opening the blow-out preventer to release the cable, thereby allowing the electric submersible pump to travel further down the well.

20. The method of claim 19, further comprising the step of:

attaching a running tool to the cable hanger and using the running tool to run the cable hanger into position relative to the piping spool.

21. The method of claim 20, further comprising the steps of:

closing the lower master valve; and removing the blow-out preventer and lubricator prior to the step of removing the plug from the opening in the wellhead tubing hanger.

* * * * *